US007000262B2

(12) United States Patent
Bielefeld

(10) Patent No.: US 7,000,262 B2
(45) Date of Patent: Feb. 21, 2006

(54) FLEXIBLE RATCHET MECHANISM FOR THE HEADBAND OF PROTECTIVE HEADGEAR

(75) Inventor: Eric Bielefeld, Lexington, KY (US)

(73) Assignee: E.D. Bullard Company, Cynthiana, KY (US)

( * ) Notice: Subject to any disclaimer, the term of this patent is extended or adjusted under 35 U.S.C. 154(b) by 63 days.

(21) Appl. No.: 10/899,467

(22) Filed: Jul. 26, 2004

(65) Prior Publication Data

US 2006/0015986 A1 Jan. 26, 2006

(51) Int. Cl.
*A42B 1/22* (2006.01)

(52) U.S. Cl. ..... 2/418; 2/DIG. 11; 24/68 B

(58) Field of Classification Search ..... 2/416, 2/417, 418, 419, 420, 183, DIG. 11; 24/68 B, 24/69 AT, 484
See application file for complete search history.

(56) References Cited

U.S. PATENT DOCUMENTS 3,500,474 A 3/1970 Austin
4,888,831 A 12/1989 Oleson
4,942,628 A 7/1990 Freund
5,212,838 A * 5/1993 Davidson et al. ..... 132/59
5,412,811 A * 5/1995 Hildenbrand et al. ..... 2/10
5,950,245 A 9/1999 Binduga
6,481,023 B1 11/2002 Wise et al.
6,708,376 B1 * 3/2004 Landry ..... 24/68 R

* cited by examiner

*Primary Examiner*—Rodney M. Lindsey
(74) *Attorney, Agent, or Firm*—Stites & Harbison, PLLC; David W. Nagle, Jr.

(57) ABSTRACT

A ratchet mechanism for the headband of a protective helmet or other headgear allows for adjustment of the size and fit of the headband. The headband has overlapping rear end portions which are enclosed in a housing, which is comprised of an outer substantially arc-shaped housing section joined to a inner substantially arc-shaped housing section. Also contained with the housing sections is an adjustment mechanism adapted to cause lateral movement of the overlapping rear end portions of said headband with respect to one another. The outer and inner housing sections are substantially segmented into multiple discrete portions such that the respective housing sections are flexible along defined boundaries between the discrete portions to provide for a better and more comfortable fit.

17 Claims, 7 Drawing Sheets

FLEXIBLE RATCHET MECHANISM FOR THE HEADBAND OF PROTECTIVE HEADGEAR

BACKGROUND OF THE INVENTION

The present invention relates to a ratchet mechanism for the headband of a protective helmet or similar headgear, a mechanism that allows for adjustment of the size and fit of the headband.

Protective helmets are commonly worn in the industrial workplace to prevent or reduce the likelihood of head injuries. The hard hat is the most common and well-recognized protective helmet. A hard hat consists of three primary components—a shell, a headband, and a suspension system—which cooperate to reduce the potential for injury by attenuating some translational energy of the force of an impact to the helmet.

With respect to the construction and protection afforded by a hard hat, the American National Standards Institute ("ANSI") promulgates minimum performance requirements for protective helmets and further classifies helmets based on their ability to reduce the forces of impact and penetration, as well as their ability to protect against high voltage electric shock. See, for example, ANSI Z89.1-1997 (R1998), American National Standard for Industrial Head Protection.

As mentioned above, a hard hat or similar protective helmet is comprised primarily of: a shell, a headband, and a suspension system. These primary hard hat components cooperate to provide the requisite level of protection. The hard hat shell itself causes any force of impact to be spread across the surface area of the shell. The hard hat suspension separates the wearer's head from the shell such that there is an air gap between the shell and the wearer's head that provides for further attenuation of the force of an impact to the shell. Specifically, when an object strikes the shell of the hard hat, the shell itself flexes inward and the straps of the suspension system will stretch. The air gap accommodates the flexing of the shell and stretching of the straps, but, under normal conditions, prevents the wearer's head from contacting the hard hat shell.

Of course, for a hard hat to provide the appropriate level of protection, it must fit snugly on the wearer's head. In this regard, it is common for the headband of a hard hat to be adjustable to provide for such a snug fit. In this regard, a headband typically has one of two common sizing mechanisms, a pin-lock arrangement or a ratchet mechanism. Regardless of the chosen sizing mechanism, the headband is commonly a flexible, one-piece member that has overlapping rear end portions. With a pin-lock mechanism, a first of the rear end portions of the headband is provided with a pin, and the second of the rear end portions is provided with series of holes at spaced intervals. As such, the pin of the first rear end portion can be inserted through one of the holes of the second rear end portion, thus forming a loop of a selected circumference to fit snugly around the wearer's head. With a ratchet mechanism, lateral movement of the overlapping rear end portions of the headband is effectuated through a rack and pinion arrangement or similar gear arrangement.

As one example of a ratchet mechanism, reference is made to U.S. Pat. No. 4,888,831 issued to Oleson, a patent that is incorporated herein by this reference. As described in the '831 patent, a preferred ratchet mechanism is often a rack and pinion arrangement which operates within elongated overlapping slots defined by the rear end portions of the headband, each of said slots defining a series of teeth of a rack gear. The rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections.

Referring still to the '831 patent, and specifically FIG. 3, one preferred rack and pinion arrangement includes five components: (1) an adjusting knob; (2) a first sprocket that is operably secured to the adjusting knob and engages mating gear teeth defined by the outer housing section, the rearward facing of the two housing sections that enclose the headband; (3) a second sprocket that is operably secured to the first sprocket and engages the teeth of the rack gears of the overlapping rear end portions of the headband; (4) a plate or washer interposed between the first and second sprockets; and (5) a spring or similar biasing member interposed between the first sprocket and the plate so as to bias the first sprocket into engagement with the mating gear teeth defined by the outer housing section. The adjusting knob, first sprocket, and the second sprocket all turn together, with clockwise rotation of the adjusting knob tightening the headband, and counterclockwise rotation of the adjusting knob loosening the headband. The interposed plate and spring bias the first sprocket into engagement with the mating gear teeth defined by the outer housing section so that the rear end portions of the headband do not slide or move without appropriate action by the wearer. In other words, since the interposed plate and spring bias the first sprocket into engagement with the mating gear teeth defined by the outer housing section, the position of the rear end portions of the headband is locked absent manipulation of the adjustment knob by the wearer.

For another example of a rack and pinion arrangement, reference is made to U.S. Pat. No. 5,950,245 issued to Binduga. Again, the headband has overlapping rear end portions. Elongated slots are defined by the rear end portions of the headband, with each of said slots defining a series of teeth of a rack gear. As described in the '245 patent with reference to FIGS. 1 and 2, the rack and pinion arrangement preferably includes (1) an adjustment knob with a first end section for providing a grip member suitable for gripping and turning by the wearer and a second end section that is a generally circular cog, the circular cog engaging the teeth of the rack gears defined by the overlapping rear end portions of the headband; (2) a spring assembly integral with or otherwise secured to the adjustment knob; (3) a housing having outer and inner arc-shaped sections that collectively define an internal cavity; and (4) a ring gear assembly fixed within the housing that cooperates with the spring assembly to provide resistance to rotation of adjustment knob. Thus, in practice, rotation of the adjustment knob causes lateral movement of the overlapping rear end portions of the headband relative to one another. However, because the spring assembly has at least one spring tooth projecting radially and adapted for mating with radially projecting teeth of the ring gear assembly, the position of the rear end portions of the headband is essentially locked absent manipulation of the adjustment knob by the wearer.

Regardless of the specific construction of the ratchet mechanism, the plastic housing that encloses the overlapping rear end portions of a headband typically has a substantially rigid construction. Thus, despite the ability to adjust the circumference of the headband through use of the ratchet mechanism, the fit may still be less than optimal due to the rigidity of the housing, which also may cause discomfort to the wearer.

Furthermore, there are other types of protective headgear that incorporate a similar ratchet mechanism, including but not limited to, faceshields and respirator hoods. As with hard hats or other protective helmets, despite the ability to adjust the circumference of the headband through use of the ratchet mechanism, the fit may still be less than optimal due to the substantially rigid construction of the housing that encloses the overlapping rear end portions of the headband.

It would therefore be desirable to provide an improved construction for a ratchet mechanism for the headband of a protective helmet or other headgear, a mechanism that allows for adjustment of the size and fit of the headband, while also providing increased comfort to the wearer.

SUMMARY OF THE INVENTION

The present invention is a ratchet mechanism for the headband of a protective helmet or other headgear, a mechanism that allows for adjustment of the size and fit of the headband.

For example, a hard hat generally includes: a substantially rigid shell shaped to protect the wearer's head, said shell defining a bottom opening and an internal cavity for receiving the wearer's head; a headband with an absorbent brow pad; and a suspension comprised of two or more intersecting straps with respective keys secured to the distal ends thereof. Thus, to secure the suspension to the shell of the hard hat, the shell includes key sockets spaced about the periphery of the shell, each such key socket being molded into the shell and adapted to receive one of the keys. Furthermore, the headband has a plurality of upwardly extending appendages, each corresponding to a respective key of the suspension, such that the keys can be secured to the headband, completing assembly of the essential components of the hard hat. Example of a preferred construction of the keys 18 and associated key sockets, reference is made to U.S. Pat. No. 6,609,254, which is incorporated herein by reference.

The headband itself has overlapping rear end portions which are enclosed in a housing, which is preferably comprised of an outer substantially arc-shaped housing section joined to a inner substantially arc-shaped housing section, thus defining an internal cavity for receiving the overlapping rear end portions of the headband. Also contained within the internal cavity defined by the housing sections is an adjustment mechanism adapted to cause lateral movement of the overlapping rear end portions of the headband with respect to one another. Specifically, it is preferred that each of the overlapping rear end portions defines an elongated slot and associated rack gear, and the adjustment mechanism includes a rotational element with an associated pinion adapted to mate with and engage the respective rack gears of the overlapping rear end portions of the headband. An adjustment knob extends through the outer housing section to engage the rotational element, such that rotation of the adjustment knob causes rotation of the rotational element, which, because of the mating and engaging of the pinion with the respective rack gears of the overlapping rear end portions, causes lateral movement of the overlapping rear end portions with respect to one another.

However, since prior art constructions of a ratchet mechanism inevitably involve a substantially rigid plastic housing, even though the headband can be adjusted, the fit may still be less than optimal and also may be uncomfortable for the wearer. Thus, the outer housing section of a ratchet mechanism made in accordance with the present invention is substantially segmented into multiple discrete portions such that the outer housing section is flexible along defined boundaries between the discrete portions. Specifically, the outer housing section has a broad wall surface with shorter walls extending from the upper and lower edges of this broad wall surface. These shorter walls are provided with detents at spaced intervals, each detent being formed by angled wall portions that meet at a point, thus creating a precisely located flex point. Then, by connecting each corresponding pair of detents in the upper and lower walls with a channel or groove in the broad wall surface, defined boundaries are created, and the outer housing section is substantially segmented into multiple discrete portions.

Similarly, the inner housing section is also substantially segmented into multiple discrete portions such that it is flexible along defined boundaries between the discrete portions. In this regard, the inner housing section also has a broad wall surface with shorter walls extending from the upper and lower edges of this broad wall surface. These upper and lower walls are designed to mate with the corresponding upper and lower walls of the outer housing section to join the two housing sections together. However, rather than be provided with detents, these walls are broken at spaced intervals that correspond with the position of the detents defined in the upper and lower walls of the outer housing section. Furthermore, notches are defined in the broad wall surface, again to correspond with the position of the detents defined in the upper and lower walls of the outer housing section. By connecting each corresponding pair of notches with a channel or groove in the broad wall surface, defined boundaries are created, substantially segmenting the inner housing section into multiple discrete portions.

To join the outer housing section and the inner housing section together while avoiding interference with the ability of the housing sections of the ratchet mechanism to flex along the defined boundaries, the outside wall segments of the inner housing section are fastened to the corresponding portions of the walls of the outer housing section using a snap-fit relationship, preferably in a manner that for some limited movement of the outside segments of the outer and inner housing sections relative to one another, thus compensating for any shearing motion between the outer and inner housing sections when the housing is flexed.

As a further refinement, it is further contemplated and preferred that the inner housing section be provided with integral "pillows" to increase the comfort to the wearer. Specifically, along the side of the inner housing section that contacts the wearer's head, there are integral and substantially rectangular protrusions extending from the broad wall surface, the so-called pillows.

DESCRIPTION OF THE INVENTION

The present invention is a ratchet mechanism for the headband of a protective helmet or other headgear, a mechanism that allows for adjustment of the size and fit of the headband.

Figure 1:
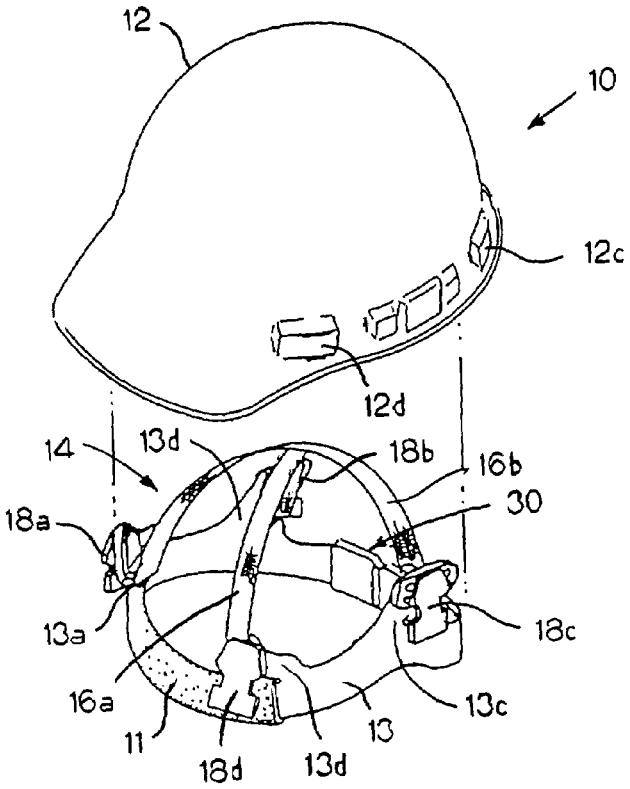
FIG. 1 is an exploded perspective view of a hard hat having an exemplary ratchet mechanism made in accordance with the present invention.

FIG. 1 is an exploded perspective view of an exemplary hard hat 10 that includes a ratchet mechanism made in accordance with the present invention. As shown, this hard hat 10 generally includes: a substantially rigid shell 12 shaped to protect the wearer's head, said shell 12 defining a bottom opening and an internal cavity for receiving the wearer's head; a headband 13 with an absorbent brow pad 11; and a suspension 14. In this exemplary embodiment, the hard hat 10 has a 4-point suspension 14 comprising two intersecting straps 16*a*, 16*b*. A key 18*a*, 18*b*, 18*c*, 18*d* is secured to each end of each of the straps 16*a*, 16*b*. Thus, to secure the suspension 14 to the shell 12 of the hard hat 10, the shell 12 includes four key sockets spaced about the periphery of the shell 12, each such key socket being molded into the shell 12 and adapted to receive one of the keys (generally and collectively indicated by reference numeral 18). In this regard, key sockets 12*c* and 12*d* are illustrated and labeled in FIG. 1. It is contemplated and preferred that the keys 18 be constructed such that they can be "locked" into the key sockets. For further detail regarding one preferred construction of the keys 18 and associated key sockets, reference is made to U.S. Pat. No. 6,609,254, which has been incorporated herein by reference.

Figure 2:
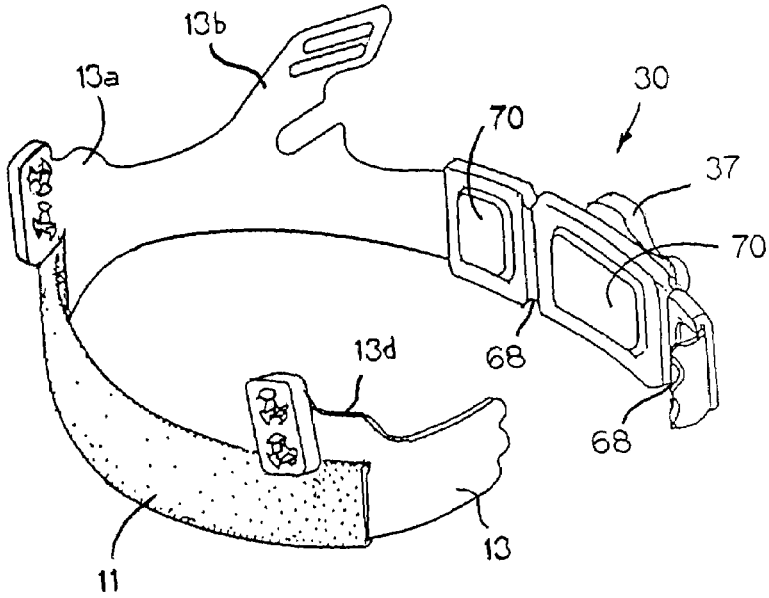
FIG. 2 is an enlarged perspective view of a portion of the headband and associated ratchet mechanism of the hard hat of FIG. 1.

As shown in FIGS. 1 and 2, the headband 13 has a plurality of upwardly extending appendages 13*a*, 13*b*, 13*c*, 13*d*. Each such appendage 13*a*, 13*b*, 13*c*, 13*d* corresponds with a respective key 18*a*, 18*b*, 18*c*, 18*d* of the suspension 14, such that the keys 18 can be secured to the headband 13, completing assembly of the essential components of the hard hat 10.

Nevertheless, the attachment of the headband 13 and suspension straps 16*a*, 16*b* to the shell 12 of the hard hat 10 is not the focus of the present application. Indeed, it is recognized that various attachment means could be employed without departing from the spirit and scope of the present invention. Rather, the present invention relates to a ratchet mechanism for the headband 13 of a hard hat 10 or other protective headgear, as generally indicated by reference numeral 30 in FIGS. 1 and 2.

Figure 3:
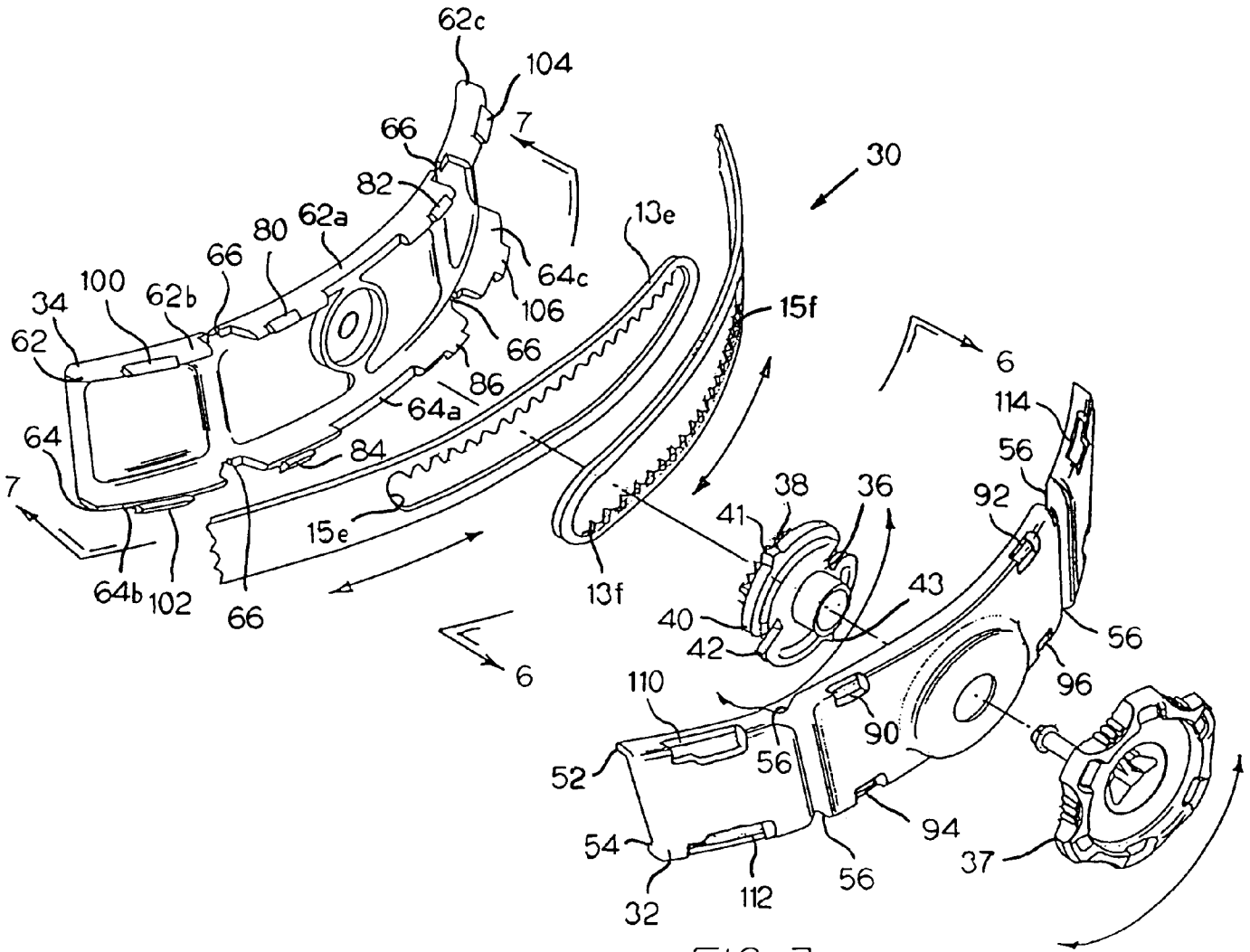
FIG. 3 is an exploded perspective view of the exemplary ratchet mechanism of the hard hat of FIG. 1.

Referring now to FIG. 3, the preferred components of a ratchet mechanism 30 made in accordance with the present invention are illustrated. First, the headband 13 itself has overlapping rear end portions 13*e*, 13*f*. Each of these portions 13*e*, 13*f* preferably defines an elongated slot 15*e*, 15*f* and associated rack gear, the rack gear of one portion 13*e* defined along the upper edge of the slot 15*e*, and the rack gear of the second portion 13*f* defined along the lower edge of the slot 15*f*.

The overlapping rear end portions 13*e*, 13*f* are enclosed in a housing, which is preferably comprised of an outer substantially arc-shaped housing section 32 joined to a inner substantially arc-shaped housing section 34, thus defining an internal cavity for receiving the overlapping rear end portions 13*e*, 13*f* of the headband 13. Each of these housing sections 32, 34 is preferably made of polypropylene or a similar plastic material. Also contained within the internal cavity defined by the housing sections 32, 34 is a rotational element 36, which includes a pinion 38. This pinion 38 is adapted to mate with and engage the respective rack gears of the overlapping rear end portions 13*e*, 13*f* of the headband 13. An adjustment knob 37 extends through the outer housing section 32 to engage the rotational element 36, such that rotation of the adjustment knob 37 turns the rotational element 36, which, because of the mating and engaging of the pinion 38 with the respective rack gears of the overlapping rear end portions 13*e*, 13*f*, causes lateral movement of the overlapping rear end portions 13*e*, 13*f* with respect to one another. Such a mechanism for effectuating the lateral movement of the overlapping rear end portions 13*e*, 13*f* of a headband 13 to accommodate adjustment of the headband 13 is known in the prior art, as described above with reference to U.S. Pat. Nos. 4,888,831 and 5,950,245, each of which has been incorporated herein by reference.

Figure 4:
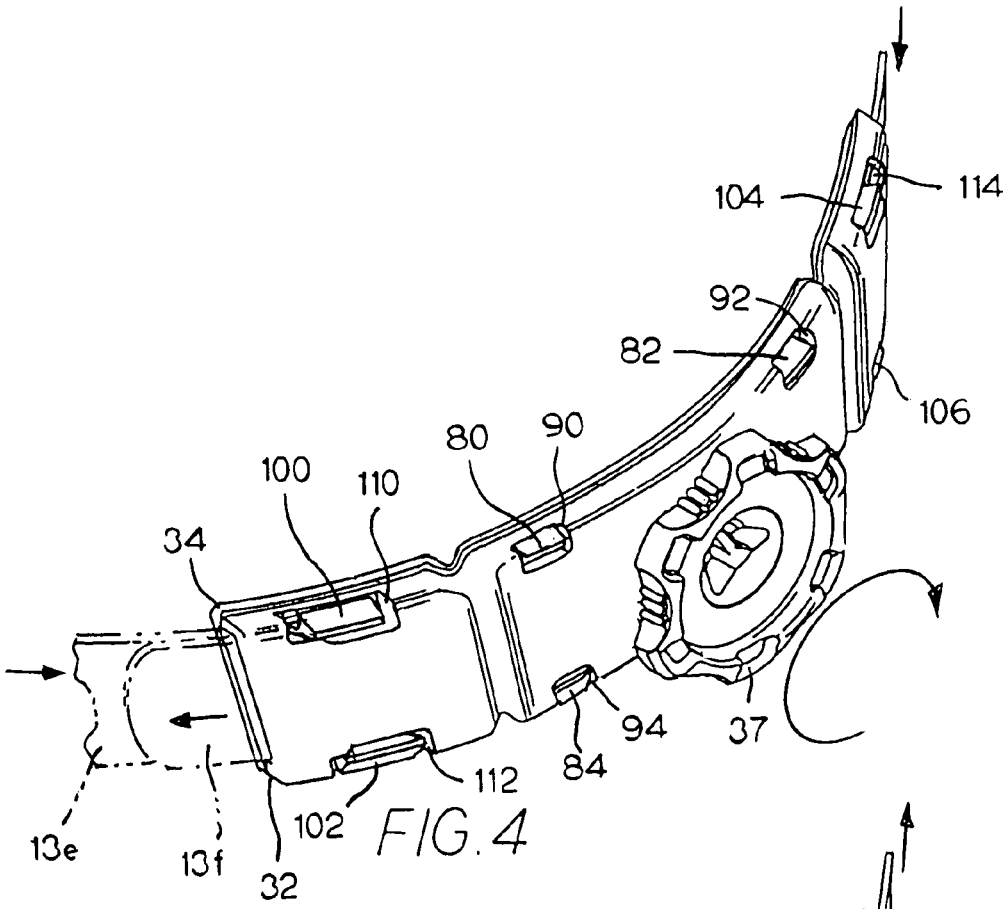
FIG. 4 is a perspective view of the exemplary ratchet mechanism of FIG. 1, illustrating movement of the rear end portions of the headband caused by clockwise rotation of an adjustment knob.
Figure 5:
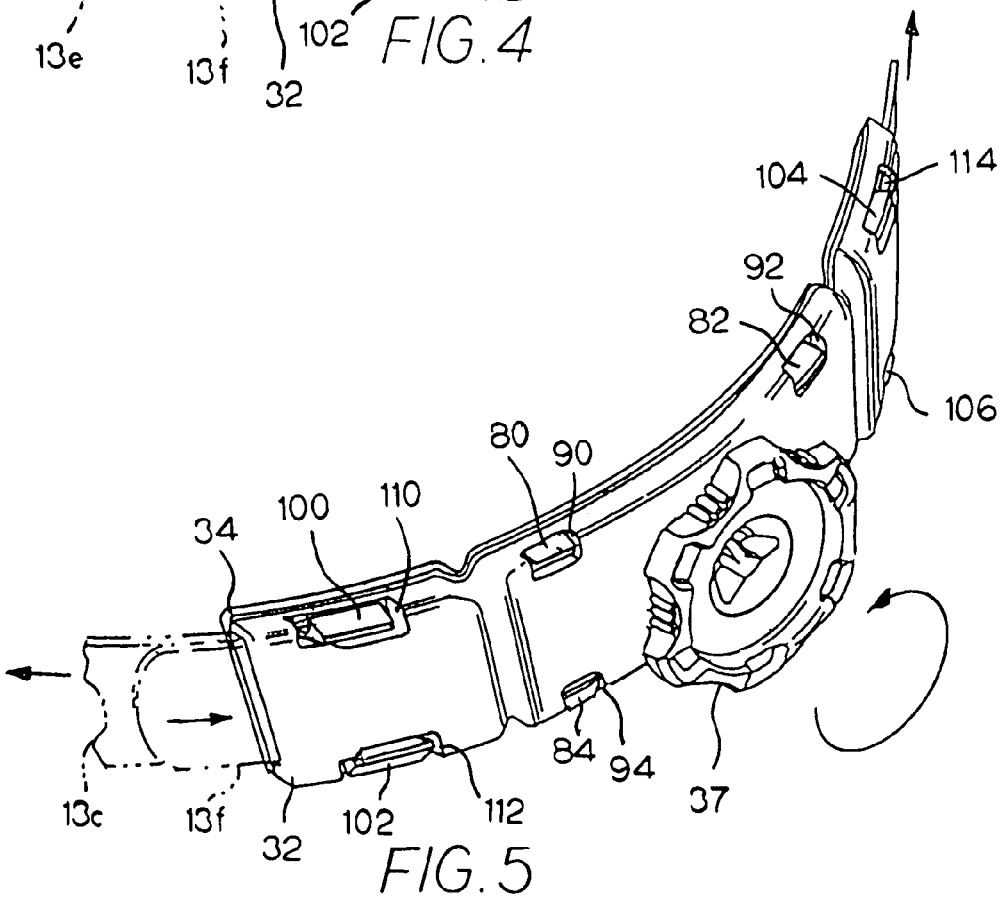
FIG. 5 is a perspective view of the exemplary ratchet mechanism of FIG. 1, illustrating movement of the rear end portions of the headband caused by counterclockwise rotation of the adjustment knob.
Figure 6:
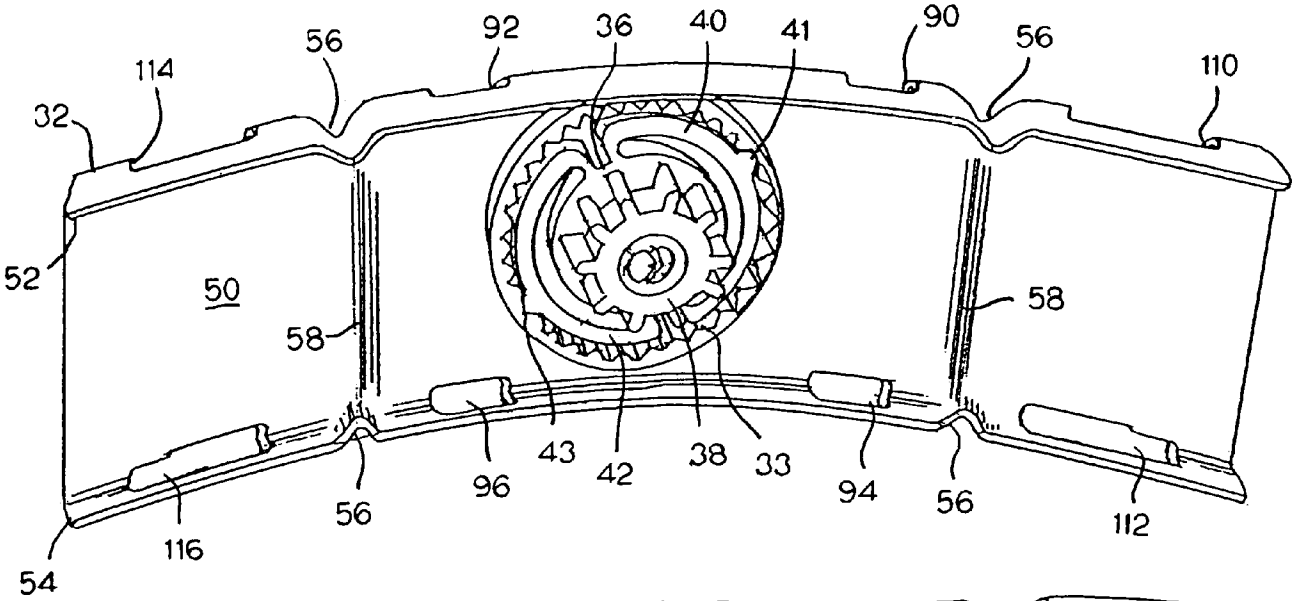
FIG. 6 is a perspective view of the outer housing section of the exemplary ratchet mechanism of FIG. 1 taken along line 6—6 of FIG. 3, with the rotating element received in the ring gear.
Figure 6A:
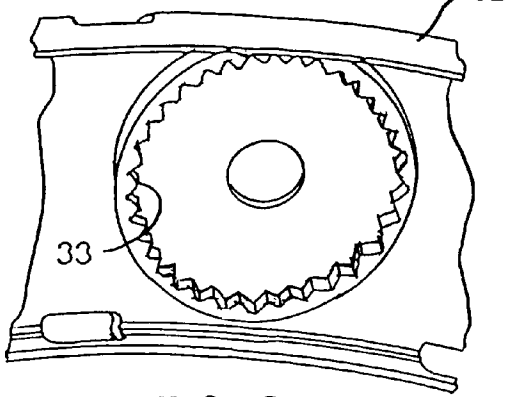
FIG. 6A is a perspective view of the outer housing section of the exemplary ratchet mechanism of FIG. 1, similar to the view of FIG. 6, but with the rotating element removed to better illustrate the ring gear.

Furthermore, similar to prior art constructions, the rotational element 36 is further provided with an integral spring assembly, which, in this exemplary embodiment, is comprised of two substantially semi-circular arch portions 40, 42 disposed on opposite sides of the central axis of rotation of the rotational element 36. A spring tooth 41, 43 extends from each of the arch portions 40, 42. As best shown in FIGS. 6 and 6A, the outer housing section 32 defines a ring gear 33 that circumscribes the opening through which the adjustment knob 37 passes. Thus, the respective spring teeth 41, 43 extending from each of the arch portions 40, 42 of the spring assembly mate with and engage the teeth of the ring gear 33, locking the position of the rotational element 36, and thus the rear end portions 13*e*, 13*f* of the headband 13 relative the outer housing section 32. However, when the adjustment knob 37 and rotational element 36 are manually turned by a wearer, the spring teeth 41, 43 are forced over the teeth of the ring gear 33 by radially inward compression of the arch portions 40, 42 of the spring assembly. In other words, by imparting a sufficient torque on the adjustment knob 37 and rotational element 36, the wearer can overcome the spring force and effectuate lateral movement of the overlapping rear end portions 13*e*, 13*f* of the headband 13 relative to one another. As shown in FIG. 4, clockwise rotation of the adjustment knob 37 moves the rear end portions 13*e*, 13*f* of the headband toward one another, decreasing the circumference of the headband 13. On the other hand, as shown in FIG. 5, counterclockwise rotation of the adjustment knob 37 moves the rear end portions 13*e*, 13*f* of the headband away one another, increasing the circumference of the headband 13. Once the wearer ceases rotation of the adjustment knob 37 and rotational element 36, the spring teeth 41, 43 are restored to engagement with the teeth of the ring gear 33, again locking the position of the rear end portions 13*e*, 13*f* of the headband 13.

However, as mentioned above, since prior art constructions of a ratchet mechanism inevitably involve a substantially rigid plastic housing, even though the headband can be adjusted, the fit may still be less than optimal and also may be uncomfortable for the wearer. Therefore, it would be desirable to provide a housing for enclosing the ratchet mechanism that is constructed so as to allow for some flexibility.

Referring again to FIG. 6, the outer housing section 32 of a ratchet mechanism 30 made in accordance with the present invention is substantially segmented into multiple discrete portions such that the outer housing section 32 is flexible along defined boundaries between the discrete portions. Specifically, in this exemplary embodiment, the outer housing section 32 has a broad wall surface 50 with a height that is slightly greater than the width of the rear end portions 13*e*, 13*f* of the headband 13. Shorter walls 52, 54 extend from the upper and lower edges of this broad wall surface 50. In other words, the outer housing section 32 has a substantially C-shaped cross-section. To obtain the desired flexibility, these walls 52, 54 are provided with detents 56 at spaced intervals. Each detent 56 is formed by angled wall portions that meet at a point. Furthermore, it is preferred that these angled wall portions have a thickness that is less than the nominal thickness of the wall 52, 54, creating a weakened area in the walls 52, 54 that causes "collapse" of the walls at the detent 56, creating a precisely located flex point. Then, by connecting each corresponding pair of detents 56 in the upper and lower walls 52, 54 of the outer housing section 32 with a channel or groove 58 in the broad wall surface 50, defined boundaries are created, and the outer housing section 32 is substantially segmented into multiple discrete portions. Thus, the outer housing section 32 is flexible along the defined boundaries between the discrete portions.

Figure 7:
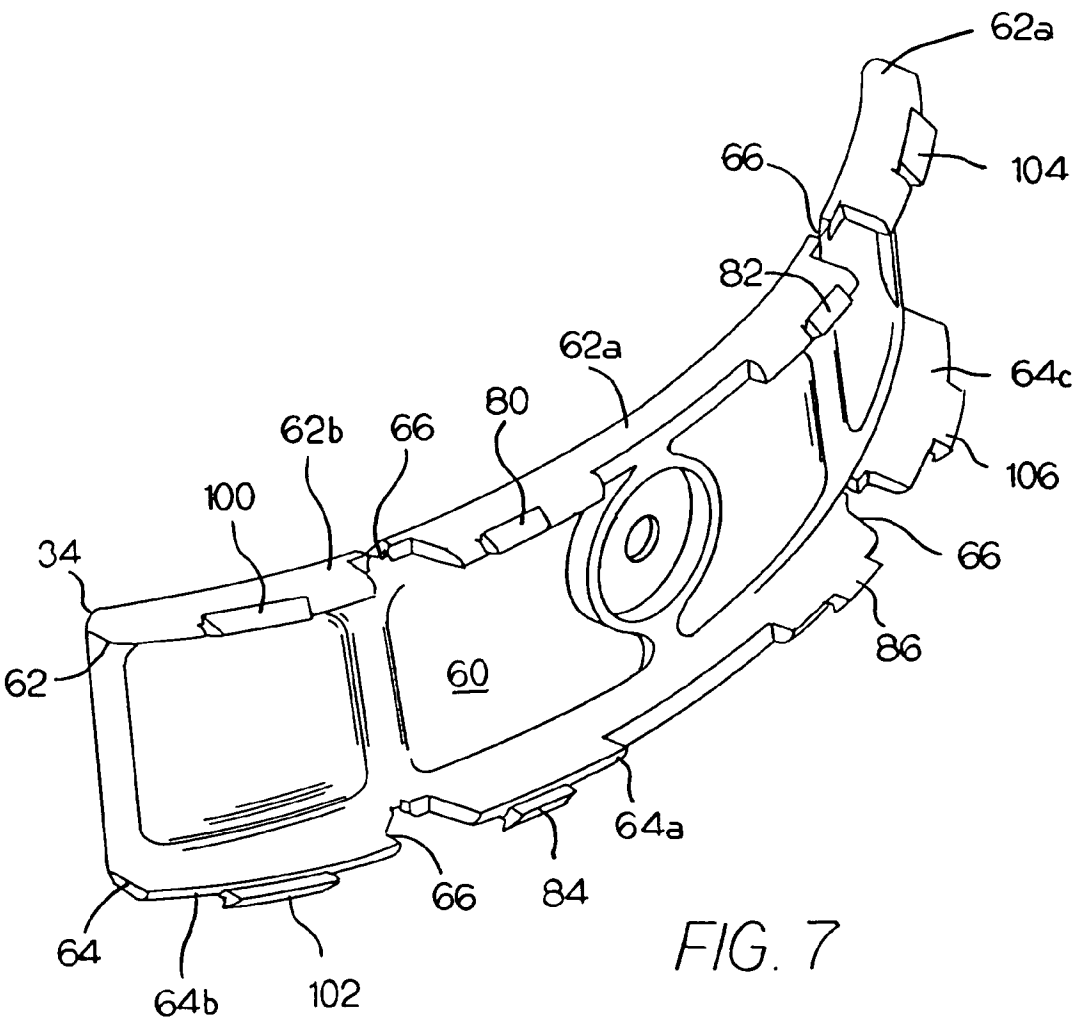
FIG. 7 is a perspective view of the inner housing section of the exemplary ratchet mechanism of FIG. 1 taken along line 7—7 of FIG. 3.

Referring now to FIG. 7, the inner housing section 34 of a ratchet mechanism 30 made in accordance with the present invention is also substantially segmented into multiple discrete portions such that it is flexible along defined boundaries between the discrete portions. Similar to the outer housing section 32, the inner housing section 34 has a broad wall surface 60 with shorter walls 62, 64 that extend from the upper and lower edges of this broad wall surface 60. These upper and lower walls 62, 64 are designed to mate with the corresponding upper and lower walls 50, 52 of the outer housing section 32 to join the two housing sections 32, 34 together, as is further described below. However, rather than be provided with detents, these walls 62, 64 are broken at spaced intervals that correspond with the position of the detents 56 defined in the upper and lower walls 52, 54 of the outer housing section 32. Furthermore, notches 66 are defined in the broad wall surface 60, again to correspond with the position of the detents 56 defined in the upper and lower walls 52, 54 of the outer housing section 32. By connecting each corresponding pair of notches 66 with a channel or groove 68 (as shown in FIG. 2) in the broad wall surface 60, defined boundaries are created, substantially segmenting the inner housing section 34 into multiple discrete portions.

To join the outer housing section 32 and the inner housing section 34, various techniques could be used with departing from the spirit and scope of the present invention. In this exemplary embodiment, the outer and inner housing sections 32, 24 are fastened together in a snap-fit relationship with the shorter walls 62, 64 of the inner housing section 34 fitting inside of and adjacent to the shorter walls 52, 54 of the outer housing section 32. Specifically, referring still to FIG. 7, the center wall segments 62*a*, 64*a* of the inner housing section 34 each include a pair of integral projecting tabs 80, 82, 84, 86, with each such tab extending from a respective wall segment 62*a*, 64*a* in a substantially parallel relationship to the broad wall surface 60. Referring again to FIG. 6, the outer housing section 32 is provided with mating openings 90, 92, 94, 96. As such, when the housing sections 32, 34 are pressed together, the projecting tabs 80, 82, 84, 86 of the inner housing section 34 are received and retained by the mating openings 90, 92, 94, 96 of the outer housing section 32, as generally illustrated in FIGS. 4 and 5, and as will be described in further detail below with reference to FIGS. 8–10.

Furthermore, in this exemplary embodiment, each of the outside wall segments 62*b*, 62*c*, 64*b*, 64*c* of the inner housing section 34 are fastened to the corresponding portions of the walls 52, 54 of the outer housing section 32 using a snap-fit relationship. Specifically, referring again to FIG. 7, the outside wall segments 62*b*, 62*c*, 64*b*, 64*c* each include an integral projecting tab 100, 102, 104, 106, with each such tab extending in a substantially parallel relationship to the broad wall surface 60. Referring again to FIG. 6, the outer housing section 32 is provided with mating openings 110, 112, 114, 116. As such, when the housing sections 32, 34 are pressed together, the projecting tabs 100, 102, 104, 106 of the inner housing section 34 are received and retained by the mating openings 110, 112, 114, 116 of the outer housing section 32, as generally illustrated in FIGS. 4 and 5. Unlike the openings 90, 92, 94, 96 defined through the center portion of the outer housing section 32, however, the outer openings 110, 112, 114, 116 each has a width that is larger than that of the corresponding tab 100, 102, 104, 106. As such, each tab 100, 102, 104, 106 can "ride" or move within the corresponding openings 110, 112, 114, 116. As such, when the ratchet mechanism 30 is flexed along the defined boundaries, the openings 110, 112, 114, 116 allow for some limited movement of the outside segments of the outer and inner housing sections 32, 34 relative to one another, thus compensating for any shearing motion between the outer and inner housing sections 32, 34 when the housing is flexed.

Figure 8:
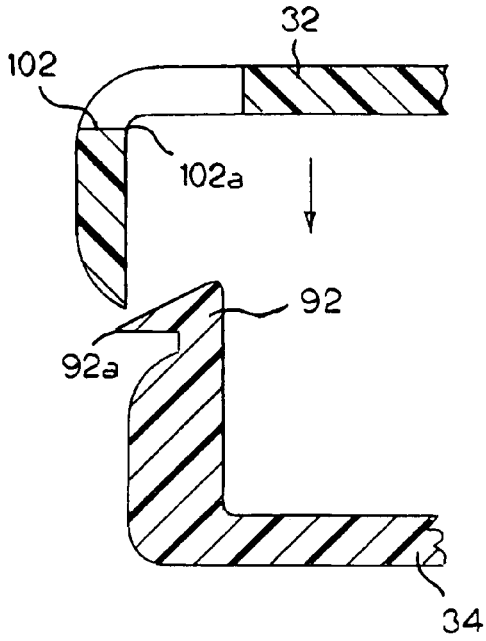
FIGS. 8–10 are sectional views of the inner and outer housing sections of the exemplary ratchet mechanism of FIG. 1, illustrating how the respective housing sections are joined to one another.
Figure 9:
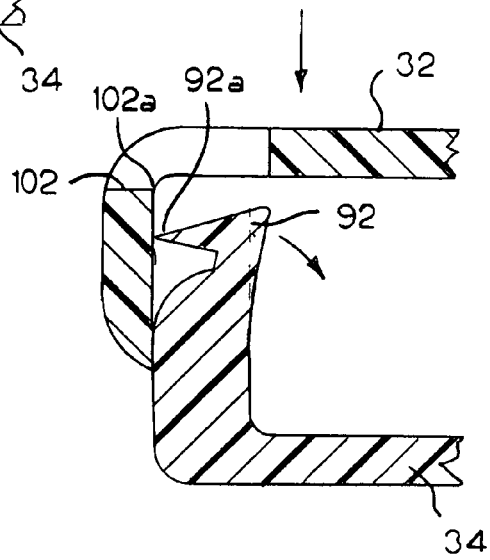
Figure 10:
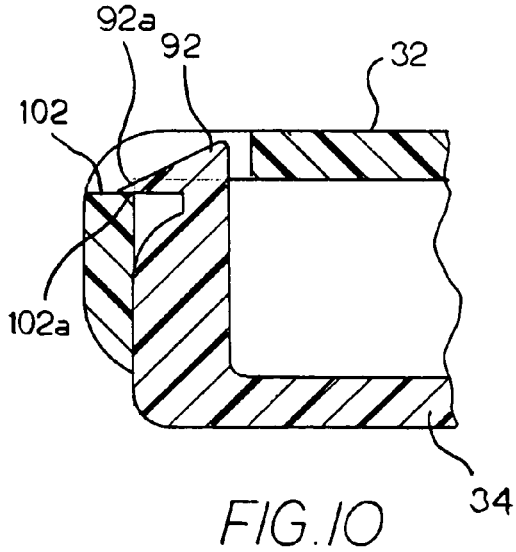

To further explain the snap-fit relationships described above, FIGS. 8–10 are sectional views that illustrate how one projecting tab 92 of the inner housing section 34 is received and retained by an opening 102 of the outer housing section 32. As illustrated in FIGS. 8–10, as the outer section 32 is pressed against the inner housing section 34, the triangular shape of the projecting tab 92 causes it to flex and rotate inwardly. This continues until the tip 92*a* of the tab 92 clears the lip 102*a* of the opening 102. Then, the projecting tab 92 returns to its original, upright position with the tip 92*a* of the tab 92 engaging the lip 102*a* of the opening 102. Each of the other projecting tabs has a similar construction, creating the snap-fit relationship that joins the inner housing section 34 to the outer housing section 32.

Figures 11A, 11B, 12A, 12B:
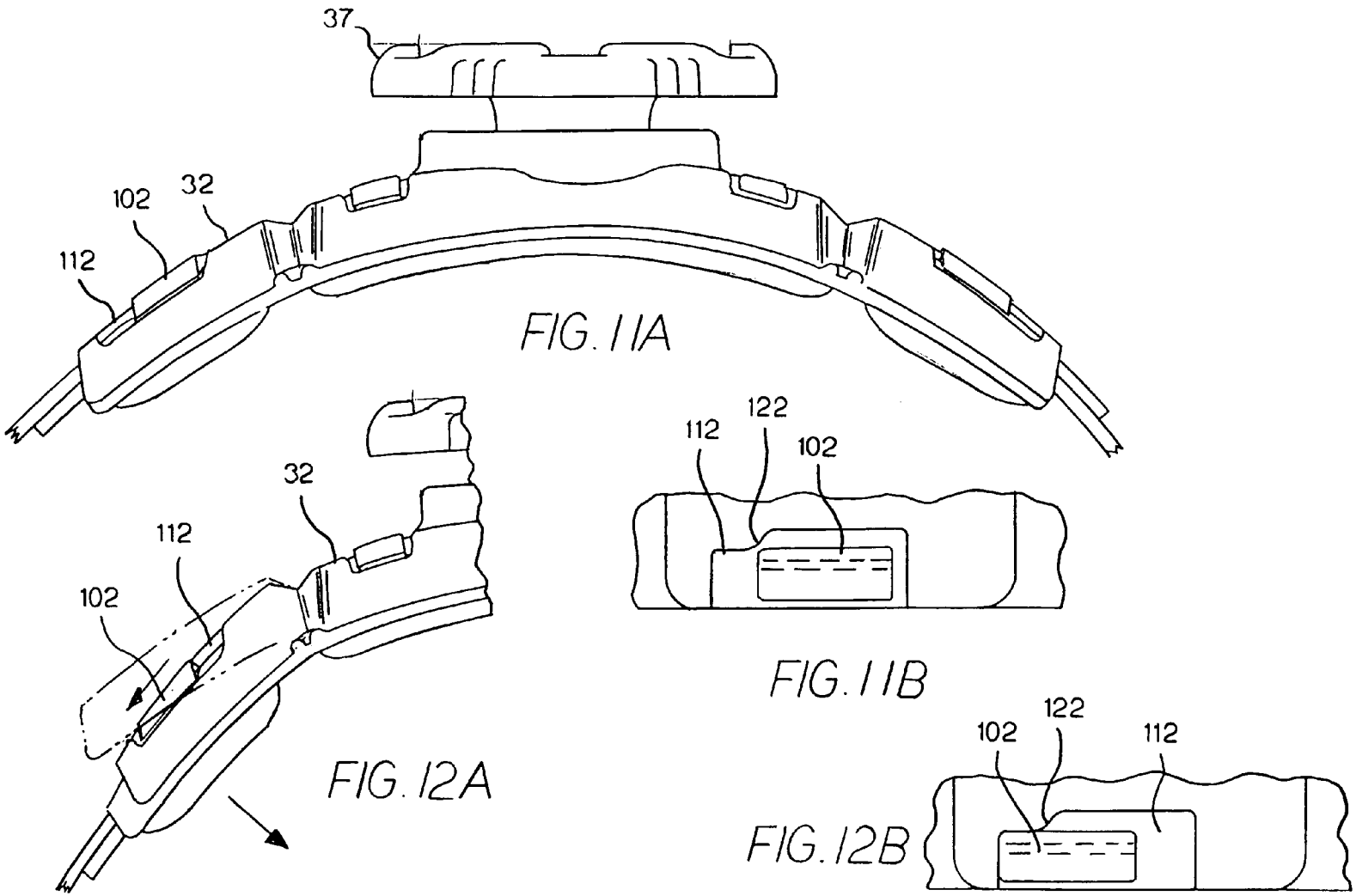
FIG. 11A is a partial perspective view of the exemplary ratchet mechanism of FIG. 1, illustrating the relationship between an outer tab and a retaining bump when the exemplary ratchet mechanism is in a resting position.
FIG. 11B is a detailed view of the relationship between the outer tab and the retaining bump when the exemplary ratchet mechanism is in the resting position illustrated in FIG. 11A.
FIG. 12A is a partial perspective view of the exemplary ratchet mechanism of FIG. 1, illustrating the relationship between an outer tab and a retaining bump when the exemplary
FIG. 12B is a detailed view of the relationship between the outer tab and the retaining bump when the exemplary ratchet mechanism is in the flexed position illustrated in FIG. 12A.

Finally, as described above, when the ratchet mechanism 30 is flexed inwardly along the defined boundaries, each outer tab 100, 102, 104, 106 will "ride" along the corresponding opening 110, 112, 114, 116 until it reaches the end of that opening 110, 112, 114, 116. The position of the tabs 100, 102, 104, 106 in relation to the openings 110, 112, 114, 116 at this point defines a yield point for the snap-fit function. If the ratchet mechanism 30 is flexed beyond this yield point, the natural reaction is for the tabs 100, 102, 104, 106 to begin to move away from and disengage the lips of the respective openings 110, 112, 114, 116, thus reversing the snap-fit motion illustrated in FIGS. 8–10. In short, the snap-fit would fail. Therefore, as a further refinement to control and prevent failure, each of the openings 110, 112, 114, 116 in this exemplary embodiment includes a retaining bump. On such retaining bump 122 is illustrated in FIGS. 11A, 11B, 12A, and 12B. When the ratchet mechanism 30 is flexed inwardly toward the yield point, the tab 102 will move between the retaining bump 122 and the edge of the opening 112, as illustrated in FIGS. 12A and 12B. If the housing is flexed beyond the yield point, the retaining bump 122 will retain the tab 102 in a locked position relative to the opening 112. In this regard, it should be recognized that the natural or resting position of the ratchet mechanism 30, as illustrated in FIGS. 11A and 11B, is the suggested position when the ratchet mechanism 30 is assembled. This position allows each outer tab 102 adequate clearance from the retaining bump 122, so that the tab 102 can momentarily flex and then "snap" or lock onto the opening 112 as described above with reference to FIGS. 8–10.

Thus, the ratchet mechanism 30 of the present invention allows for adjustment of the size and fit of the protective helmet 10 or other headgear, and because of the flexibility of the outer and inner housing sections 32, 34, a better and more comfortable fit can be obtained. As mentioned above, although the exemplary ratchet mechanism described herein is incorporated into a hard hat, the ratchet mechanism of the present invention can certainly be incorporated into other types of headgear that have an adjustable headband, such as faceshields and respirator hoods, without departing from the spirit and scope of the present invention.

As a further refinement, and as illustrated in FIGS. 1 and 2, it is further contemplated and preferred that the inner housing section 34 be provided with integral "pillows" to increase the comfort to the wearer. Specifically, along the side of the inner housing section 34 that contacts the wearer's head, there are integral and substantially rectangular protrusions extending from the broad wall surface 60, the so-called pillows 70. These pillows 70 are preferably integrally molded into the inner housing section 32 with a thickness that is less than the nominal thickness of the broad wall surface 60. Furthermore, the pillows 70 are preferably offset from the edges of the inner housing section 34 and the defined boundaries between the discrete segments of the housing section 34 so as to avoid stiffening or deformation of the pillows 70.

It will be obvious to those skilled in the art that further modifications may be made to the embodiments described herein without departing from the spirit and scope of the present invention.

What is claimed is:

1. A ratchet mechanism for a headband that has overlapping rear end portions, comprising:

a housing including an outer substantially arc-shaped housing section joined to a inner substantially arc-shaped housing section, thus defining an internal cavity for receiving the overlapping rear end portions of said headband;

an adjustment mechanism substantially contained within the internal cavity defined by said housing sections and adapted to cause lateral movement of the overlapping rear end portions of said headband with respect to one another; and wherein the outer housing section is substantially segmented into multiple discrete portions such that the outer housing section is flexible along defined boundaries between such discrete portions, and wherein the inner housing section is similarly and substantially segmented into corresponding discrete portions such that the inner housing section is also flexible along defined boundaries between such discrete portions, such that, when the outer and inner housing sections are joined, the housing of the ratchet mechanism has a flexibility that allows it to conform to the head shape of a wearer.

2. The ratchet mechanism as recited in claim 1, wherein the overlapping rear end portions of said headband each define an elongated slot and associated rack gear; and wherein said adjustment mechanism includes a rotational element contained within the internal cavity defined by said housing sections, said rotational element including a pinion which is adapted to mate with and engage the respective rack gears of the overlapping rear end portions of said headband, and further including a spring assembly adapted to engage a portion of one of said housing sections to resist rotation of the rotational element relative to said housing sections, and an adjustment knob secured to said rotational element such that rotation of the adjustment knob results in rotation of the rotational element, the pinion of the rotational element engaging the respective rack gears of the overlapping rear end portions of said headband and causing lateral movement of the overlapping rear end portions of said headband with respect to one another.

3. The ratchet mechanism as recited in claim 1, wherein the outer housing section has a broad wall surface with shorter walls extending from upper and lower edges of the broad wall surface, said shorter walls being provided with detents at spaced intervals, each corresponding pair of detents in the shorter walls being connected by a channel in the broad wall surface, thus providing the outer housing section with the desired flexibility.

4. The ratchet mechanism as recited in claim 3, wherein the inner housing section has a broad wall surface with shorter walls extending from upper and lower edges of the broad wall surface, said shorter walls being broken at spaced intervals that correspond with the position of the detents defined in the shorter walls of the outer housing section.

5. The ratchet mechanism as recited in claim 4, wherein notches are defined in the broad wall surface of the inner housing section to correspond with the position of the detents defined in the shorter walls of the outer housing section, each corresponding pair of notches being connected by a channel in the broad wall surface, thus providing the inner housing section with the desired flexibility.

6. The ratchet mechanism as recited in claim 5, wherein portions of the shorter walls of one of said housing sections are provided with projecting tabs that extend from the shorter walls in a substantially parallel relationship to the broad wall surface, and wherein corresponding openings are defined through the shorter walls of the other of said housing sections, such that, when the outer and inner housing sections are joined together, the projecting tabs are received and retained in the openings to fasten the outer and inner housing sections together, while still allowing for limited movement of the housing sections with respect to one another.

7. The ratchet mechanism as recited in claim 1, in which a side of the inner housing section that contacts a wearer's head is provided with integral pillows to increase comfort to the wearer.

8. The ratchet mechanism as recited in claim 7, in which said pillows are molded into the inner housing section and are offset from edges of the inner housing section and the defined boundaries between the discrete segments of the inner housing section.

9. The ratchet mechanism as recited in claim 1, wherein the outer housing section has a broad wall surface with shorter walls extending from upper and lower edges of the broad wall surface, said shorter walls being provided with detents at spaced intervals, each corresponding pair of detents in the shorter walls being connected by a channel in the broad wall surface, thus providing the outer housing section with the desired flexibility.

10. The ratchet mechanism as recited in claim 9, wherein the inner housing section has a broad wall surface with shorter walls extending from upper and lower edges of the broad wall surface, said shorter walls being broken at spaced intervals that correspond with the position of the detents defined in the shorter walls of the outer housing section.

11. The ratchet mechanism as recited in claim 10, wherein notches are defined in the broad wall surface of the inner housing section to correspond with the position of the detents defined in the shorter walls of the outer housing section, each corresponding pair of notches being connected by a channel in the broad wall surface, thus providing the inner housing section with the desired flexibility.

12. The ratchet mechanism as recited in claim 11, wherein portions of the shorter walls of one of said housing sections are provided with projecting tabs that extend from the shorter walls in a substantially parallel relationship to the broad wall surface, and wherein corresponding openings are defined through the shorter walls of the other of said housing sections, such that, when the outer and inner housing sections are joined together, the projecting tabs are received and retained in the openings to fasten the outer and inner housing sections together, while still allowing for limited movement of the housing sections with respect to one another.

13. The ratchet mechanism as recited in claim 2, wherein the rotational element of said adjustment mechanism is provided with an integral spring assembly comprised of two substantially semi-circular arch portions, with a spring tooth extending from each of said arch portions and adapted to engage the teeth of a ring gear defined by the outer housing section, thus locking the position of the rotational element unless a wearer imparts a sufficient torque on the adjustment knob and the rotational element.

14. The ratchet mechanism as recited in claim 2, in which a broad wall surface of said inner housing section is provided with integral pillows to increase comfort to the wearer.

15. The ratchet mechanism as recited in claim 14, in which said pillows have a thickness that is less than a nominal thickness of the broad wall surface of said inner housing section, and in which said pillows are offset from edges of the inner housing section and the defined boundaries between the discrete segments of the inner housing section.

16. In combination with an article of protective headgear with an internal suspension, a ratchet mechanism for an adjustable headband, comprising:

a housing including an outer substantially arc-shaped housing section joined to a inner substantially arc-shaped housing section, thus defining an interrut cavity for receiving overlapping rear end portions of said headband and allowing for lateral movement of the overlapping rear end portions of said headband with respect to one another within said internal cavity; and a means for selectively adjusting and maintaining a desired overlap of the overlapping rear end portions of said headband;

wherein the outer housing section is substantially segmented into multiple discrete portions such that the outer housing section is flexible along defined boundaries between such discrete portions, and wherein the inner housing section is similarly and substantially segmented into corresponding discrete portions such that the inner housing section is also flexible along defined boundaries between such discrete portions, such that, when the outer and inner housing sections are joined, the housing of the ratchet mechanism has a flexibility that allows it to conform to the head shape of a wearer.

17. The ratchet mechanism for an adjustable headband as recited in claim 16, wherein the overlapping rear end portions of said headband each define an elongated slot and associated rack gear, and wherein said means for selectively adjusting and maintaining a desired overlap of the overlapping rear end portions of said headband comprises:

a rotational element contained within the internal cavity defined by said housing sections, said rotational element including a pinion which is adapted to mate with and engage the respective rack gears of the overlapping rear end portions of said headband, and further including a spring assembly adapted to engage a portion of one of said housing sections to resist rotation of the rotational element relative to said housing sections, and an adjustment knob secured to said rotational element such that rotation of the adjustment knob results in rotation of the rotational element, the pinion of the rotational element engaging the respective rack gears of the overlapping rear end portions of said headband and causing lateral movement of the overlapping rear end portions of said headband with respect to one another.

* * * * *